US010500623B2

(12) United States Patent
Meneghetti

(10) Patent No.: US 10,500,623 B2
(45) Date of Patent: Dec. 10, 2019

(54) SHEET METAL BENDING MACHINE

(71) Applicant: SALVAGNINI ITALIA S.P.A., Sarego (VI) (IT)

(72) Inventor: Nicola Meneghetti, Villaga (IT)

(73) Assignee: SALVAGNINI ITALIA S.P.A., Sarego (IT)

( * ) Notice: Subject to any disclaimer, the term of this patent is extended or adjusted under 35 U.S.C. 154(b) by 678 days.

(21) Appl. No.: 15/117,593

(22) PCT Filed: Feb. 9, 2015

(86) PCT No.: PCT/IB2015/050960
§ 371 (c)(1),
(2) Date: Aug. 9, 2016

(87) PCT Pub. No.: WO2015/118505
PCT Pub. Date: Aug. 13, 2015

(65) Prior Publication Data

US 2016/0354821 A1 Dec. 8, 2016

(30) Foreign Application Priority Data

Feb. 10, 2014 (IT) ..... BO2014A0061
Feb. 10, 2014 (IT) ..... BO2014A0062

(51) Int. Cl.
*B21D 37/04* (2006.01)
*B21D 5/02* (2006.01)
(Continued)

(52) U.S. Cl.
CPC ..... *B21D 5/02* (2013.01); *B21D 5/004* (2013.01); *B21D 5/0218* (2013.01);
(Continued)

(58) Field of Classification Search
CPC ..... B21D 5/02; B21D 5/004; B21D 5/0254; B21D 5/0218; B21D 37/14; B21D 37/145; B21J 13/08
(Continued)

(56) References Cited

U.S. PATENT DOCUMENTS 4,660,402 A * 4/1987 Hongo ..... B21D 5/02 72/319
4,680,955 A * 7/1987 Sakamoto ..... B21D 5/02 100/918
(Continued)

FOREIGN PATENT DOCUMENTS

EP 0 310 145 4/1989
EP 1 658 908 5/2006
(Continued)

OTHER PUBLICATIONS

Notice of Reasons for Rejection dated Aug. 29, 2017 in corresponding Japanese Application No. 2016-551219, with English translation.
(Continued)

*Primary Examiner* — David B Jones
(74) *Attorney, Agent, or Firm* — Wenderoth, Lind & Ponack, L.L.P.

(57) ABSTRACT

A bending machine for sheet metal comprises a bending assembly (2) provided with a tool holder crosspiece (3) which is mobile and supports a set (20) of bending tools (40, 41, 42, 43, 44) which are aligned, and mutually positionable, along a first longitudinal direction (A) so as to form predetermined compositions (C1, C2, C3, C4) of bending tools suitable to bend a workpiece (50) according to respective defined bending lines; the bending assembly (2) comprises a moving assembly (5, 6) to move the bending tools (40, 41, 42, 43, 44) along the crosspiece (3), the set (20) of bending tools comprises, arranged adjacent and in sequence starting
(Continued)

from an end (3*a*) of said crosspiece (3): four first bending tools (41) having a width of X+p, one second bending tool (42) having a width of X+2·p, one third bending tool (43) having a width of X+3·p, one basic bending tool (40) having a width of X, three third bending tools (43), one fourth bending tool (44) having a width of X+4·p, two basic bending tools (40), one first bending tool (41), one second bending tool (42), a further set (21) of basic bending tools (40), wherein X is a basic width in mm of said basic bending tool (40) comprised between 30 mm and 70 mm, and p is a step between two lengths of subsequent tool compositions (C1, C2, C3, C4), comprised between 5 mm and 20 mm; the combination of one or more adjacent tools (40, 41, 42, 43, 44) of said set (20) of bending tools allows obtaining bends having all the lengths starting from a minimum bending length equal to said basic width (X) with said step (p).

28 Claims, 11 Drawing Sheets

(51) Int. Cl.
*B21D 5/00* (2006.01)
*B21J 13/08* (2006.01)
*B21D 37/14* (2006.01)

(52) U.S. Cl.
CPC ..... *B21D 5/0254* (2013.01); *B21D 37/14* (2013.01); *B21D 37/145* (2013.01); *B21J 13/08* (2013.01)

(58) Field of Classification Search
USPC ..... 72/386, 462, 413, 478
See application file for complete search history.

(56) References Cited

U.S. PATENT DOCUMENTS

| | | | | | |
|---|---|---|---|---|---|
| 5,168,745 | A * | 12/1992 | Miyagawa | ..... | B21D 5/02 483/29 |
| 9,975,161 | B2 * | 5/2018 | Sato | ..... | B21D 5/004 |
| 2003/0064871 | A1 * | 4/2003 | Akami | ..... | B21D 5/02 483/1 |

FOREIGN PATENT DOCUMENTS

| | | | | | |
|---|---|---|---|---|---|
| EP | 1925374 | * | 5/2008 | ..... | B21D 37/04 |
| FR | 2.122.977 | | 9/1972 | | |
| JP | 58-18021 | | 2/1983 | | |
| JP | S58148021 | * | 3/1983 | ..... | B21D 5/00 |
| JP | 58-76326 | | 5/1983 | | |
| JP | 60-41292 | | 12/1985 | | |
| JP | 60-244426 | | 12/1985 | | |
| JP | 4-158926 | | 6/1992 | | |
| JP | 7-100540 | | 4/1995 | | |
| JP | 2006-346707 | | 12/2006 | | |
| JP | 2008-87018 | | 4/2008 | | |
| JP | 5008019 | | 8/2012 | | |
| WO | 2014/002569 | | 1/2014 | | |

OTHER PUBLICATIONS

Notice of Grounds for Rejection dated Sep. 11, 2017 in corresponding Korean Application No. 10-2016-7025235, with English translation.
International Search Report dated Aug. 17, 2015 in corresponding International (PCT) Application No. PCT/IB2015/050960.
Chinese Office Action dated Feb. 14, 2018 in corresponding Chinese Patent Application No. 201580008048.X with English translation.

* cited by examiner

SHEET METAL BENDING MACHINE

The invention concerns to bending machines arranged for bending and deforming strips, sheet metals, metal section bars so as to obtain semi-finished products and/or finished products. In particular, the invention relates to a bending machine provided with a modular and sectional punch, formed by a set of bending tools that are fixed in a slidable and adjustable manner to a tool holder crosspiece of the machine. The invention also relates to a bending machine provided with a system for automatically replacing and/or positioning the bending tools.

Bending machines are known, also referred to as bending press, comprising a mechanically or hydraulically driven press capable of moving an upper tool, so called punch, to abut against a lower tool, so called die, on which the workpiece is positioned. The punch exerts on the workpiece a force that is able to deform and bend the workpiece according to an angle determined by the configuration of the tools themselves.

A type of bending machines comprises a punch or bending assembly that includes a blade or knife with rounded edges and is capable to deform the metal workpiece along a predetermined bending line. The workpiece is blocked on the machine worktable by suitable clamping means, so called blankholder means. Generally, the punch or bending blade is composed of a set of bending tools or segments fixed to a movable tool holder crosspiece so as to form a modular and sectional punch. Number and size (width) of the tools are selected according to the length of the bend to be carried out and/or the dimensions of the workpiece, while the type of tools is selected as a function of the type of bending (angle, shape).

Typically, in order to carry out a bending having a predetermined length on the workpiece, it is necessary to select, among the set of tools mounted on the crosspiece, the adjacent tools having such dimensions (width) to allow precisely obtaining the required length. Since the dimensions of the tools are standardized and discretely variable (typically in steps of 10 mm) according to predetermined formats (widths), obtaining the required bends with the set of tools currently mounted on the crosspiece is not always possible. Therefore, in order to carry out successive and different working cycles, it is often necessary to replace, at least partially, the bending tools mounted on the tool holder crosspiece.

When it is necessary to carry out multiple operations or workings to obtain the desired product from the initial workpiece (typically manufacturing a panel from a planar sheet metal), the latter has to be sequentially transferred on a plurality of bending machines, for example arranged in a line.

If the workpiece has reduced dimensions, it is possible to carry out all the operations in a single bending machine, by moving the above-mentioned piece through subsequent stations or working areas of the machine in which the bending tools mounted on the same tool holder crosspiece carry out the necessary bends. In this case, the bending tools have to be suitably selected and arranged along the crosspiece according to the required compositions in the corresponding different stations so as to obtain the subsequent bends.

Also in this case, in order to obtain the different tool compositions that are necessary to an operative cycle, it is necessary to often replace, at least partially, the bending tools mounted on the crosspiece.

Automatic replacement and assembling systems of the bending tools are provided on the known bending machine tools to assemble/disassemble, position on the crosspiece the bending tools necessary for different operations. The above-mentioned systems comprise gripping and transferring means, which mount in the desired positions on the crosspiece the tools withdrawn from a tool holder magazine, typically arranged within the machine, behind the crosspiece or above it. Furthermore, the above-mentioned gripping means removes the tools to be replaced from the crosspiece and insert them into the magazine.

The gripping and transferring means comprises external manipulator, such as robots, or articulated mechanisms, which insert and withdraw the required tools by rotation and/or translation movements so as to obtain on the tool holder crosspiece the tool compositions having the required lengths.

In some bending machines, only some tools so called size tools, typically arranged in the central part of the crosspiece, are replaced.

A drawback of the known bending machine tools is that to carry out bends with different lengths, a replacement of the tools is required in order to carry out tool compositions having the required lengths. In order to carry out assembling and/or disassembling operations of the tools (which have to be withdrawn and/or placed in the magazine), it is necessary a considerable time interval during which the machine has to be stopped, thus interrupting the production and consequently decreasing the machine output.

Moreover, tool replacement and/or positioning can be carried out only at the beginning of the operative cycle of the workpiece, and not during said cycle. In fact, in this case, the operative cycle duration would be too high, consequently reducing the machine output.

Another drawback of the known bending machines is that the automatic systems for tools replacing and assembling are expensive and complex because of gripping and transferring means required for assembling and disassembling the bending tools and to withdraw and insert the latter ones in suitable magazines.

JP 2006346707 discloses a bending machine, which comprises an upper table, vertically movable and provided with a punch holder element, and a stationary lower table provided with a die holder element. The punch and die holder elements of the tables slidably support respective set of punches and dies, which can be positioned by moving means along the above-mentioned punch/die holder elements so as to form defined groups of punches and dies.

EP 1658908 discloses a bending apparatus, which comprises an upper table and a lower table that support tools for performing bends on a workpiece, and a tool-exchanging device for replacing groups of tools mounted on said upper and lower tables. The tool-exchanging device consists in a plurality of racks mounted overlapping on the rear walls of the upper and lower tables, each rack being arranged to support and house a tool holder having a respective group of tools. A moving device, which can be moved vertically and horizontally, is arranged adjacent to the rear walls in order to pick up a predetermined tool holder from a rack and to insert the latter on the table, or to pick up the tool holder from the table and transfer the latter to a free rack.

WO 2014002569 discloses a bending machine provided with a tool magazine arranged to house punches and dies that can be mounted on tool holder elements of a punch and a die of the machine. The magazine comprises a plurality of linear supports arranged for housing respective plurality of aligned punches or dies. Each linear support is connected at its opposite ends to a couple of closed-loop belts which are powered so that the linear support is movable along a closed path at least in an exchange position, in which a robot may transfer the punches or the dies from said linear support to one of the tool holder elements of the machine, and vice versa.

JP S5818021 discloses a system for automatically exchanging a bending tool in a bending machine, comprising a device for removing a mobile terminal tool so as to allow removing or adding sectional tools from a tool holder element of the machine, thereby changing the width of the tool composition. The device comprises a motor for rotating the mobile terminal tool and for allowing an actuator inserting or removing the sectional tools into or from the tool holder element. A separating element linearly displaces the unused tools to a storage position. The mobile terminal tool is rotated to the original position and linearly moved to block the selected sectional tools against a terminal stationary tool.

An object of the present invention is to improve the known bending machines arranged to bend and deform strips, sheet metals, metal section bars and, in particular, the bending machines provided with modular and sectional punches, formed by a set of bending tools slidably fixed to a tool holder crosspiece.

Another object is to improve the known bending machines provided with automatic systems for positioning and/or assembling/disassembling the bending tools.

A further object is to obtain a bending machine which allows carrying out with the same set of bending tools mounted on the tool holder crosspiece all the required compositions, in a wide range of lengths, suitably separating and grouping adjacent tools.

Still another object is to provide a bending machine that allows carrying out tool compositions in a rapid and precise manner, minimizing the machine downtimes, in particular allowing configuring and arranging the tools even during the operative cycle of the workpiece to perform on the latter subsequent and consecutive workings.

Still a further object is to obtain a bending machine that allows assembling/disassembling and/or positioning in a rapid and precise manner the bending tools that are necessary to the required workings, minimizing the machine downtimes.

A further object is to provide a bending machine provided with a system for automatically replacing and/or positioning the bending tools having a simple and inexpensive structure, and an efficient and reliable operation.

In a first aspect of the invention, a bending machine according to claim 1 is provided.

In a second aspect of the invention, a bending machine according to claim 11 is provided.

In a third aspect of the invention, a bending machine according to claim 21 is provided.

The bending machine according to the first aspect of the invention comprises a bending assembly provided with a tool holder crosspiece mobile and supporting a set of bending tools, which are aligned and mutually positionable along a longitudinal first direction so as to form predetermined compositions of adjacent tools to bend a workpiece according to respective defined bending lines. The bending assembly comprises a moving assembly to move the bending tools along the crosspiece. The set of tools comprises a particular selection and arrangement of bending tools that are arranged adjacent and in sequence starting from an end of the crosspiece. More precisely, the set comprises:

four first bending tools having a width equal to X+p;
one second bending tool having a width equal to X+2·p;
one third bending tool having a width equal to X+3·p;
one basic bending tool having a width equal to X;
three third bending tools;
one fourth bending tool having a width equal to X+4·p;
two basic bending tools;
one first bending tool;
one second bending tool;
a further set of basic bending tools.

X is a basic width in mm equal to the width of the basic bending tool and comprised between 30 mm and 70 mm, in particular equal to 50 mm, while p is a step between two lengths of subsequent tool compositions, comprised between 5 mm and 20 mm, and in particular equal to 10 mm. The further set of tools comprises a number of basic tools comprising between 1 and 46, in particular equal to 36.

The combination of one or more adjacent tools of the set of tools mounted on the crosspiece of the bending machine allows carrying out all the bending measurements with step p starting from a minimum bending length equal to the basic width X. In other words, the set of bending tools allows carrying out bends having lengths comprised between X and X+n·p, where n is an integer more than 1.

Therefore, thanks to the bending machine of the invention it is possible to carry out with the same set of bending tools mounted on the crosspiece, bends having lengths that are variable in a continuous manner with a step equal to p (10 mm) starting from a minimum value equal to X (50 mm), without the need of replacing the tools. In fact, it is possible to obtain all the required tool compositions to carry out all the different bending lengths by suitably separating and grouping adjacent tools, using the moving assembly.

Since the selection of tools slidably mounted on the crosspiece and the mutual positions thereof do not change during the operation of the machine, no assembling/disassembling operation of the tools on/from the crosspiece is necessary. The dimensions of the basic tools and size tools, the number and the mutual arrangement thereof allow obtaining all the required compositions with steps of 10 mm. The different compositions are carried out simply by separating the selected tools (always adjacent to one another) from the remaining tools, without the need for assembling on, or disassembling from, the crosspiece tools that are picked up from a tool magazine. In this way, it is possible to arrange in a fast and precise manner the bending tools necessary to the required workings, minimizing the machine downtimes, i.e. speeding up the workpiece machining time.

The bending machine of the invention allows carrying out in a fast, easy manner all the desired tool compositions even during the operative cycle of a workpiece, without unduly increasing the cycle duration, this allowing executing on the workpiece a plurality of different bends which should be usually carried out, in an operative cycle with an acceptable duration, only by using two or more bending machines arranged in line.

The set of tools and the moving assembly also allow positioning and defining different tool compositions along the crosspiece even during a same operative cycle of a workpiece for carrying out on said workpiece and in the same bending machine a plurality of different and subsequent workings.

Therefore, the bending machine of the invention provides a high operative flexibility and an optimization of the operative cycles of the workpiece.

The bending machine of the second aspect of the invention comprises a bending assembly provided with a tool holder crosspiece, which is mobile and supports a set of bending tools, which are aligned, and mutually positionable, along a longitudinal first direction so as to form predetermined compositions of tools suitable to bend a workpiece according to respective defined bending lines. The bending assembly comprises a moving assembly to move the bending tools at least along the crosspiece.

The machine includes a tool holder magazine arranged adjacent and at the side of the bending assembly to support and receive sets of bending tools and comprising at least a supporting guide, which is mobile and which can be positioned in a transfer position in which said supporting guide is aligned to the crosspiece of the bending assembly along the first direction, so as to receive from, or release to, the crosspiece the set of bending tools. The tool holder magazine comprises a pulling device slidably connected to the supporting guide and arranged for engaging the bending tools when they are housed in said supporting guide. The moving assembly is provided with a connecting device suitable to engage the bending tools to move the tools along the crosspiece and to transfer the set of bending tools from the crosspiece to the supporting guide, within the magazine, and suitable to couple the pulling device to move, by means of the latter, the set of tools from the supporting guide to the crosspiece, exiting the magazine.

Therefore, thanks to the bending machine of the invention, it is possible to replace the bending tools in an easy, fast, and efficient manner; in particular, it is possible to replace a set of bending tools with another set of tools in order to carry out different processing cycles. The replacement of the tools is carried out using the same moving assembly, which allows positioning the bending tools along the crosspiece as a function of the working(s) to be carried out on the workpiece, in particular by positioning and obtaining the different compositions or arrangements of tools, even during the operative cycle of the workpiece.

Hence, the bending machine of the invention does not require any auxiliary and dedicated moving assembly in order to pick up from the tool holder magazine, or to insert in the latter, the set of tools, than allowing simplifying the structure of the machine and reducing the cost thereof. In fact, the replacement and exchange system of the bending tools of the bending machine of the invention, which comprises the moving assembly of the bending assembly and the supporting guides of the tool holder magazine provided with the pulling device has a simple, inexpensive structure and an efficient and reliable operation.

The bending machine of the third aspect of the invention comprises a bending assembly provided with a tool holder crosspiece, which is mobile and supports a set of bending tools, which are aligned, and mutually positionable, along a longitudinal first direction so as to form predetermined compositions of tools suitable to bend a workpiece according to respective bending lines. The bending assembly comprises a moving assembly to move the bending tools at least along the crosspiece.

The machine includes a tool holder magazine arranged adjacent and at the side of the bending assembly to support and receive sets of bending tools and comprising at least a supporting guide which is mobile and which can be positioned in a transfer position at which said supporting guide is aligned to the crosspiece of the bending assembly along the first direction so as to receive from, or release to, the crosspiece the set of bending tools.

The moving assembly of the bending assembly is arranged to move and transfer the set of bending tools from the crosspiece to the supporting guide, inside the tool holder magazine. The latter comprises a pulling device slidably connected to the supporting guide and arranged to engage and transfer the set of tools from the supporting guide to the crosspiece, exiting the tool magazine. The pulling device comprises at least a powered carriage that is slidably connected to the supporting guide and is mobile along the latter to engage and push the set of bending tools from the supporting guide to the crosspiece. The powered carriage acts on the bending tool of the set of bending tools, which is the outermost and farthest one from the crosspiece.

Therefore, thanks to the bending machine of the invention, it is possible to replace the bending tools in an easy, fast, and efficient manner, in particular it is possible to replace a set of bending tools with another set of tools in order to carry out different processing cycles. The replacement of the tools is carried out by using the same moving assembly, which allow positioning the bending tools along the tool holder crosspiece, and the pulling device that is slidably connected to the supporting guide.

The invention will be better understood and implemented with reference to the appended drawings, which illustrate an exemplary, non-limiting embodiment thereof, in which.

Figure 1:
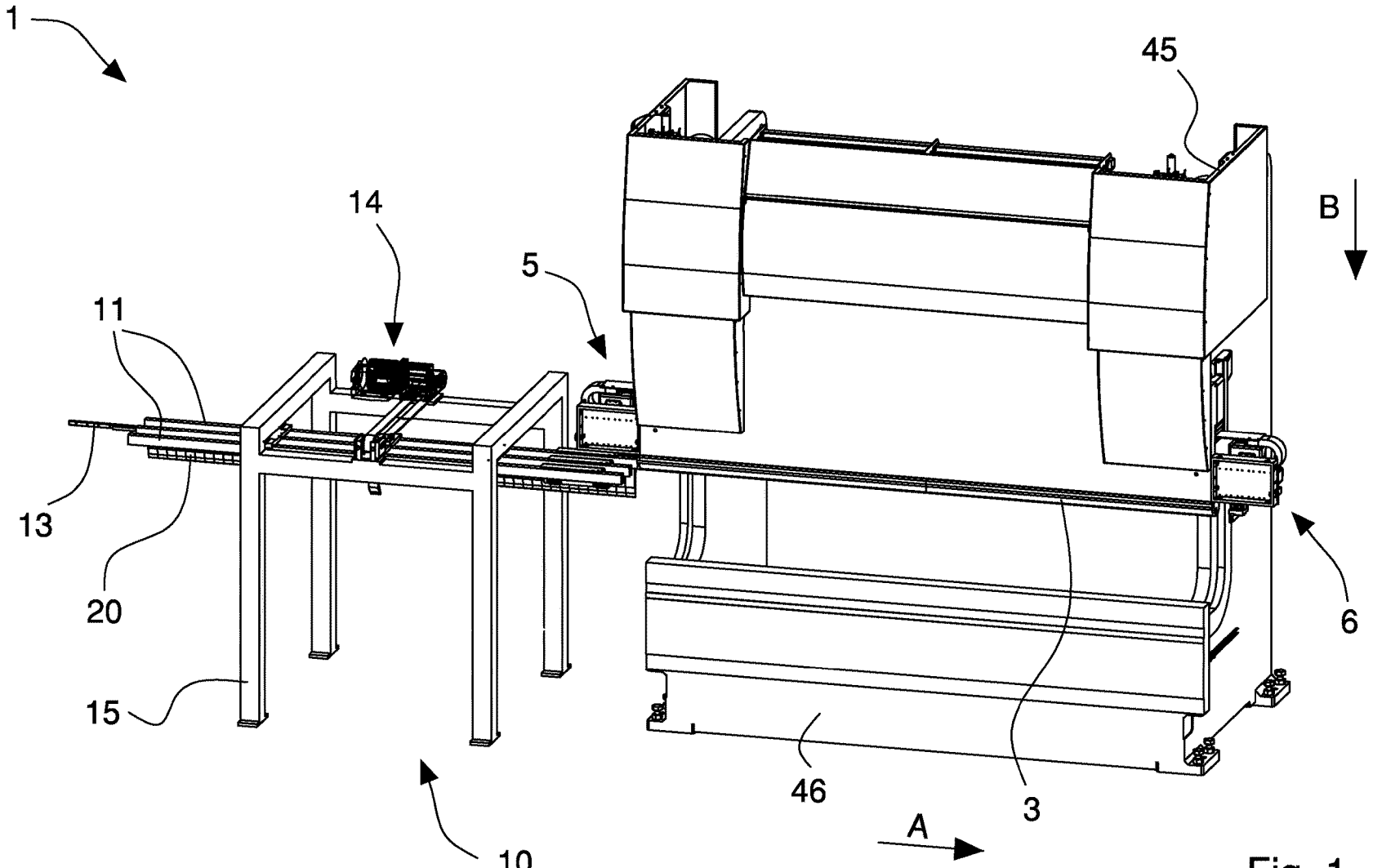
FIG. 1 is a schematic front view of the bending machine of the invention.
Figure 2:
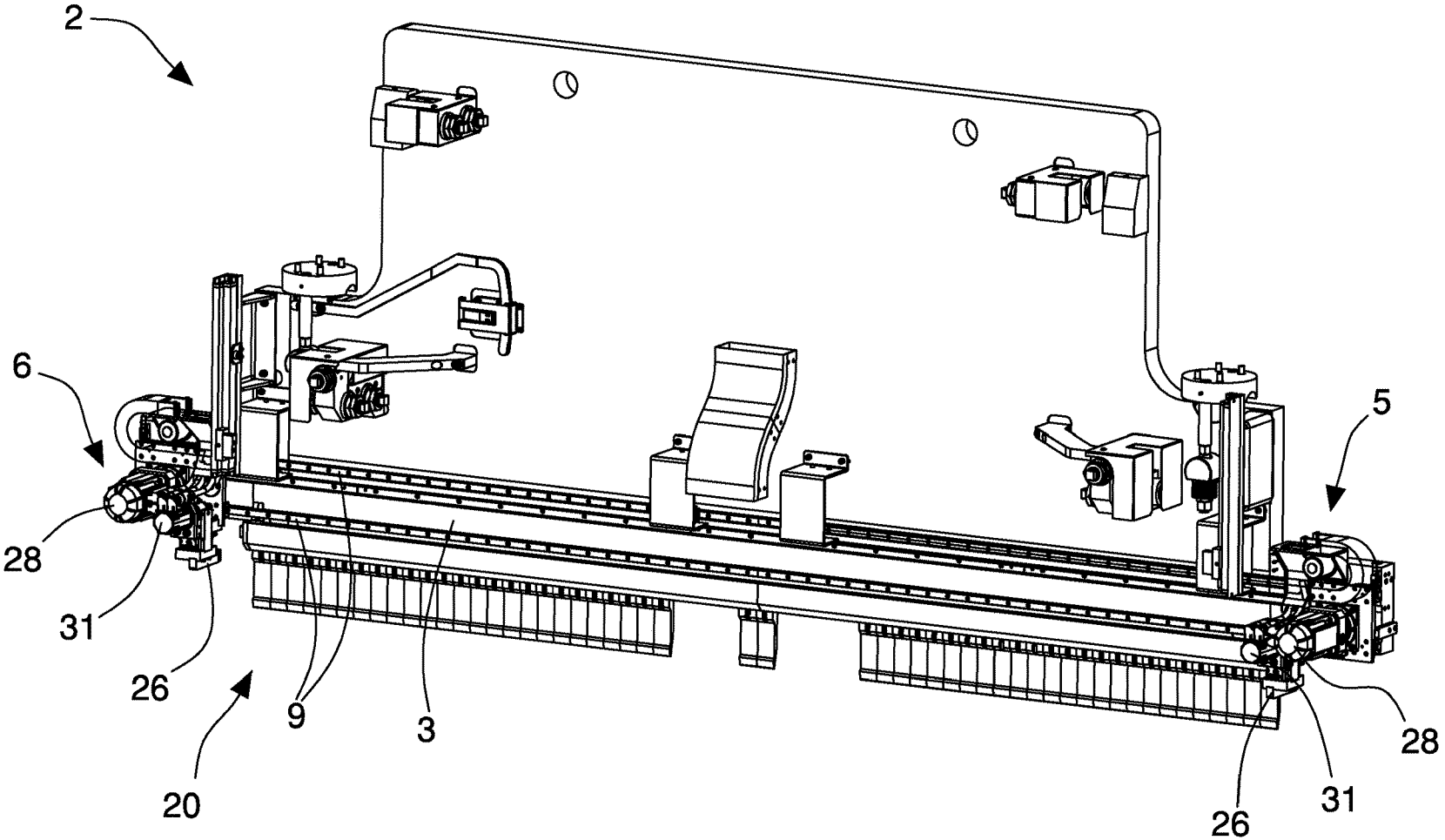
FIG. 2 is a rear perspective view of an upper bending assembly of the machine of FIG. 1.

With reference to FIGS. 1 to 12, the sheet metal bending machine 1 according to the invention is shown, which comprises a bending assembly 2 provided with a tool holder crosspiece 3 that is mobile and supports a set 20 of bending tools 40, 41, 42, 43, 44, so-called bending blades or segments, mounted aligned adjacent and mutually positionable along a longitudinal first direction A so as to form predetermined compositions C1. C2, C3, C4 of tools to bend a workpiece 50 according to respective defined bending lines.

The first direction A is parallel to the bending line carried out on the workpiece 50. The set 20 of bending tools forms a modular and sectional punch, which is slidable and adjustable along the tool holder crosspiece 3 of the machine.

The bending assembly 2 comprises a moving assembly 5, 6 for suitably moving and positioning the bending tools 40, 41, 42, 43, 44 along the crosspiece 3. The moving assembly 5, 6 is controlled in position by a managing and controlling unit of the bending machine 1.

The bending machine 1, which comprises a frame 45 suitable to support the bending assembly 2 and a base 46, can be provided with a die of a stationary or movable type, connected to the base 46 and cooperating with the bending tools 40, 41, 42, 43, 44 in order to carry out workings on the workpiece 50. A manipulating and/or locking device, of a known type and not illustrated in the figures, can be provided for moving, positioning and locking the workpiece 50 on a worktable of the bending machine 1. In particular, the moving assembly can move the workpiece 50 along the first direction A through successive stations or working areas of the bending machine 1 in which corresponding successive bending operations can be carried out.

The crosspiece 3, which comprises a beam parallel to the first direction A, is driven by mechanical and/or hydraulic actuators of a known type and not shown in the figures, in particular along a second transversal and vertical direction B.

Alternatively, the crosspiece 3 can be moved according to a curved motion trajectory, for example can be pivoted to an axis that is horizontal and parallel to the first direction A.

In the illustrated embodiment, the crosspiece 3 is arranged on top of the worktable and is movable from the top down to interact with and bend the workpiece 50.

In a variant of the bending machine 1 not shown in the figures, the crosspiece 3 can be arranged below the worktable and can be movable from the bottom up to interact with and bend the workpiece 50.

Figure 3:
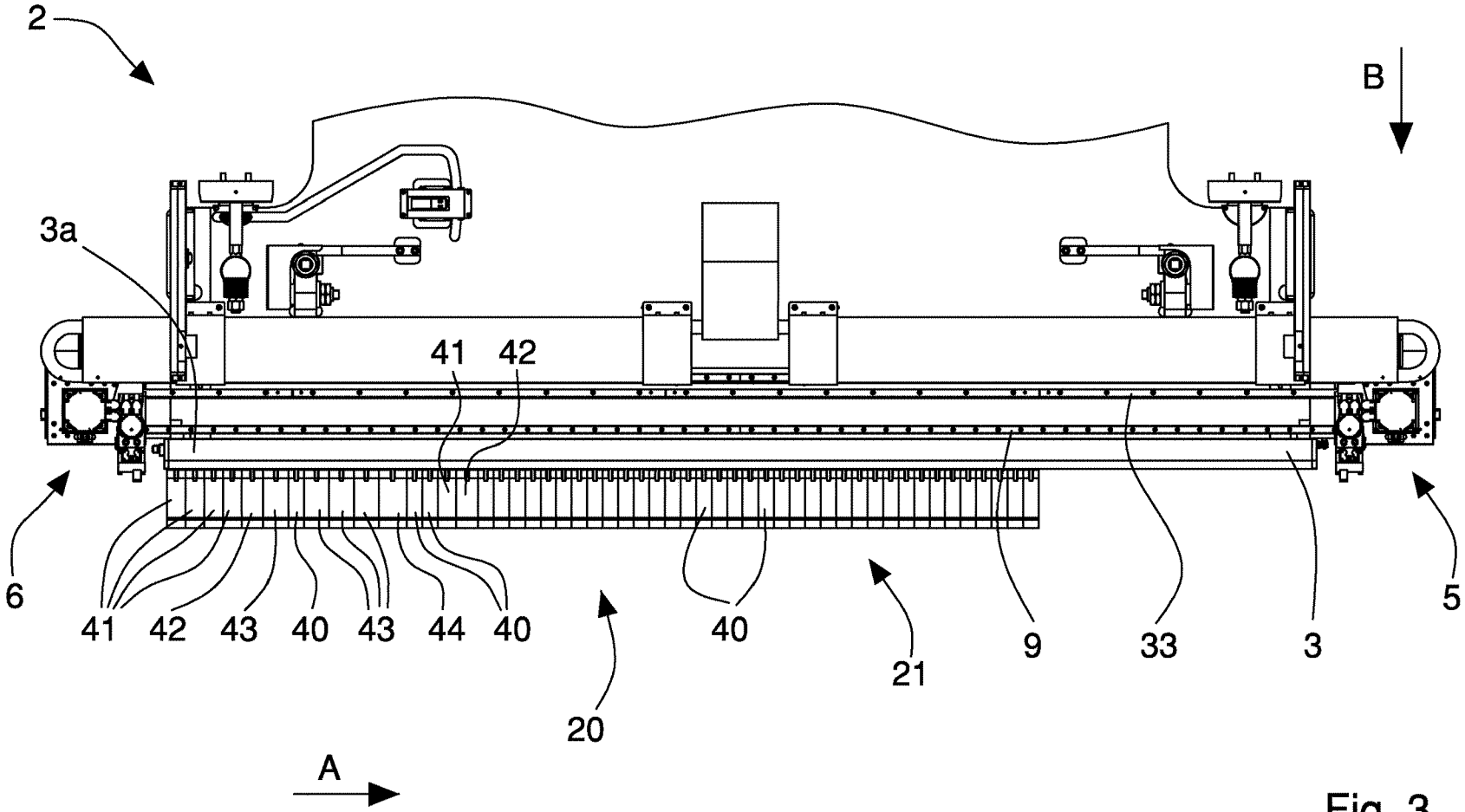
FIG. 3 is a rear view of the bending assembly of FIG. 2 showing a set of tools mounted on a tool holder crosspiece of the machine in an initial configuration.
Figure 4:
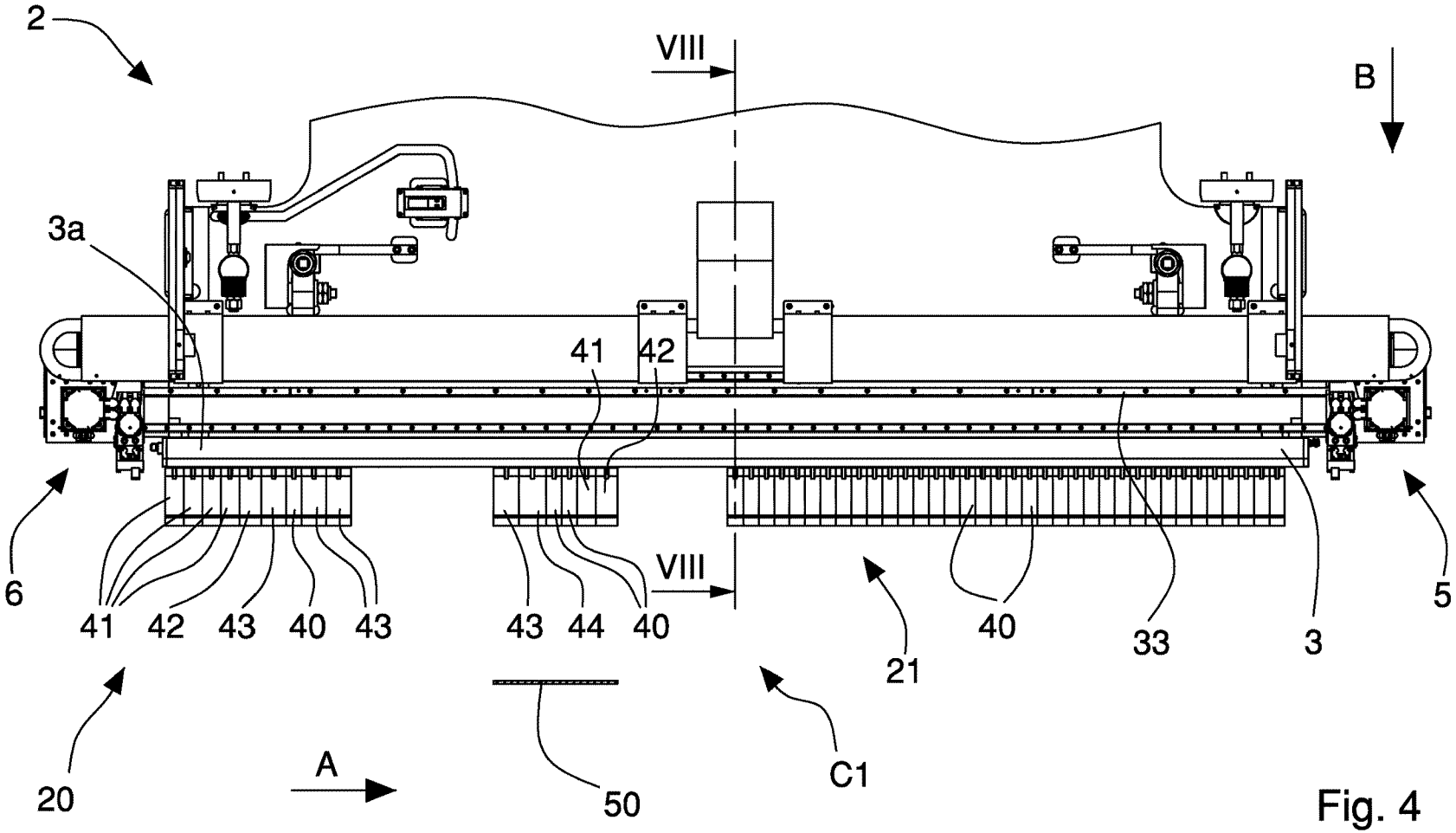
FIGS. 4 and 5 are rear views of the bending assembly of FIG. 2 showing different tool compositions on the crosspiece in order to bend a workpiece according to respective defined bending lines.
Figure 5:
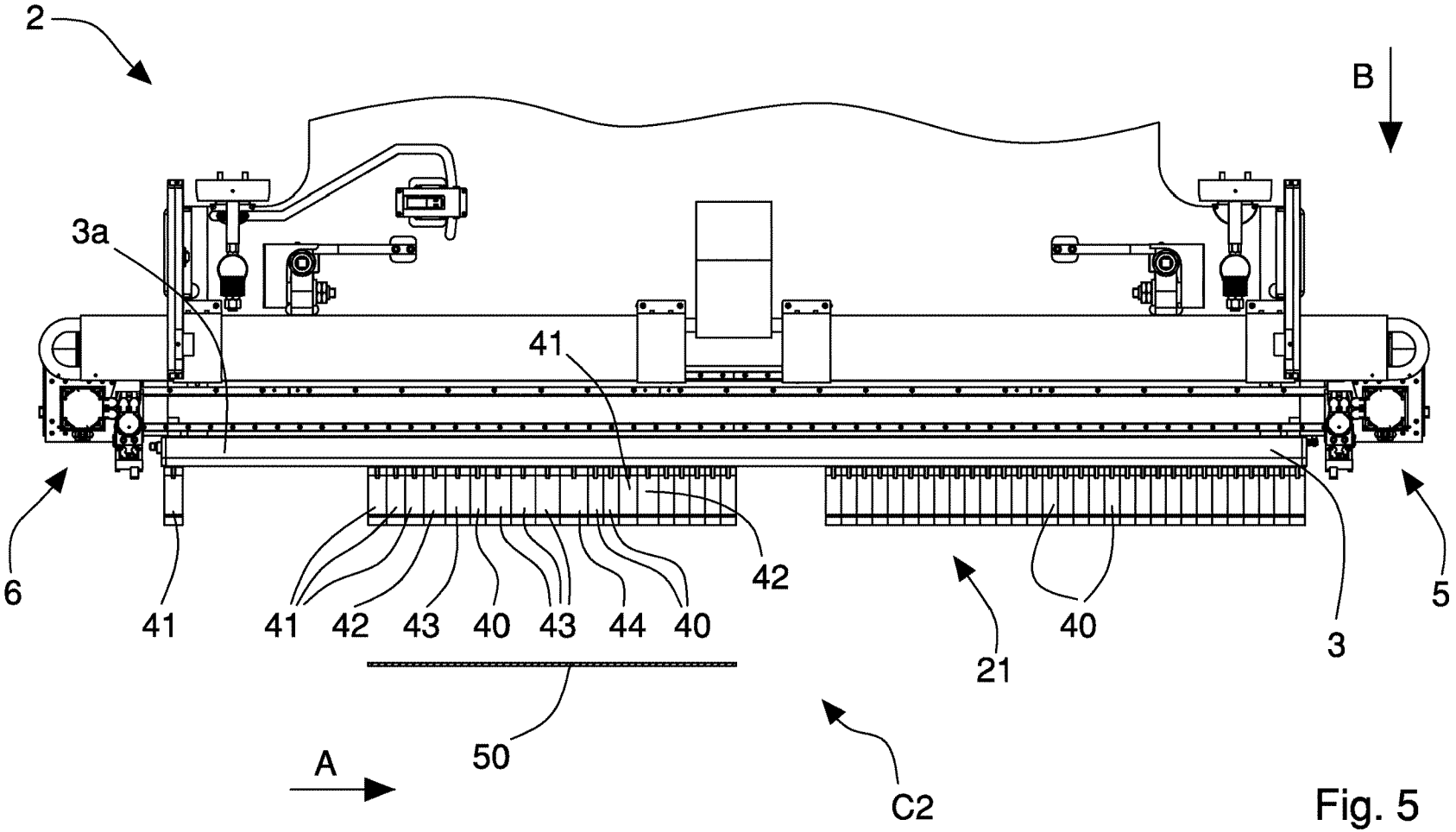
Figure 6:
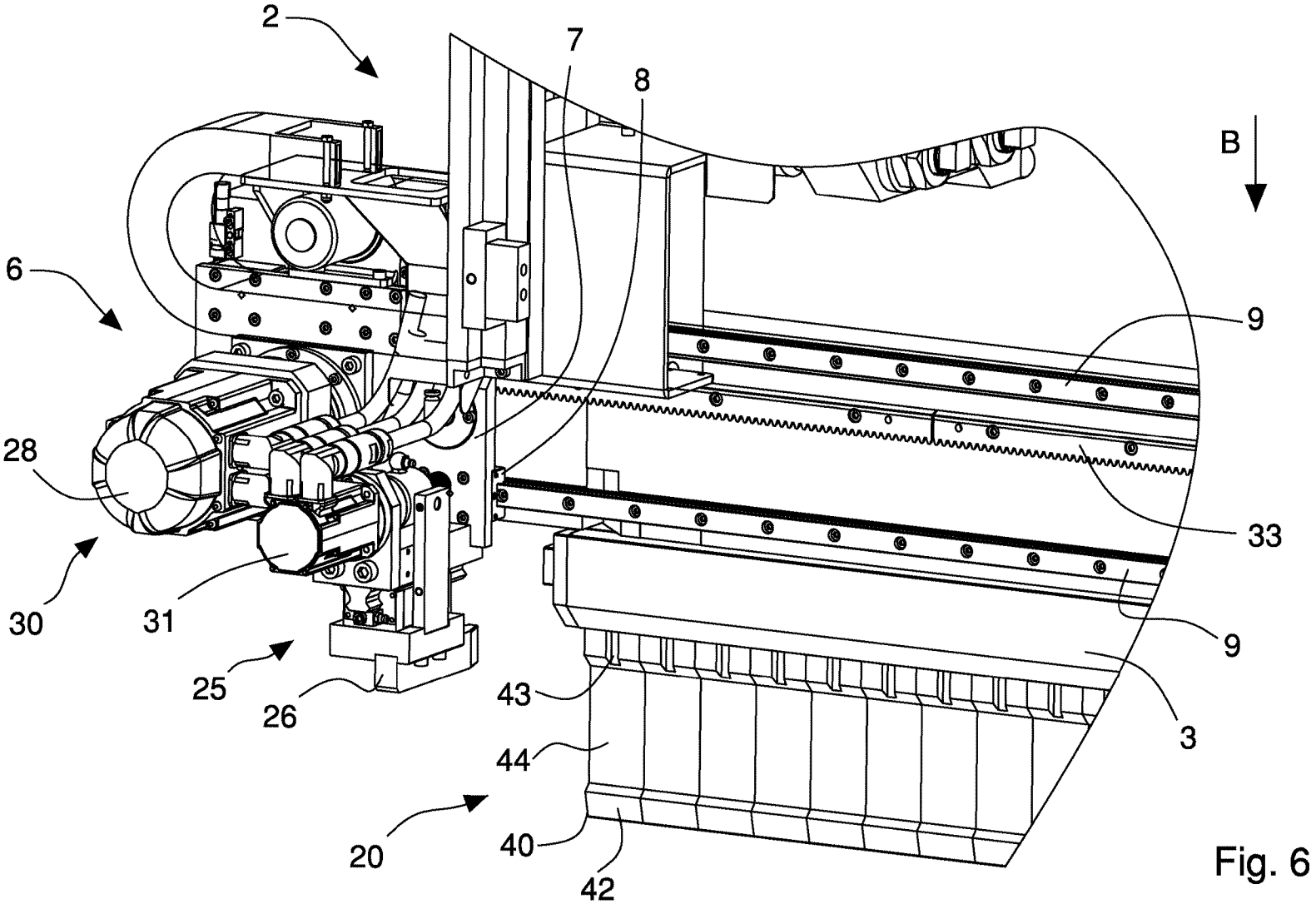
FIG. 6 is an enlarged and partial view of the bending assembly of FIG. 2 showing a moving assembly of the bending tools.

As illustrated in particular in FIGS. 3 to 5, the set 20 of bending tools mounted on the crosspiece 3 comprises, arranged adjacent and in sequence starting from an end, for example the left end 3*a* of the crosspiece 3 when observing the machine from the rear part (FIGS. 3-5):

four first bending tools 41 having a width equal to X+p;
one second bending tool 42 having a width equal to X+2·p;
one third bending tool 43 having a width equal to X+3·p;
one basic bending tool 40 having a width equal to X;
three third bending tools 43;
one fourth bending tool 44 having a width equal to X+4~p;
two basic bending tools 40;
one first bending tool 41;
one second bending tool 42;
a further set 21 of basic bending tools 40;
wherein:

X is a basic width in mm equal to the width of the basic bending tool 40 and comprised between 30 mm and 70 mm and p is a step or length difference of successive tool compositions and comprised between 5 mm and 20 mm.

The combination of one or more adjacent tools 40, 41, 42, 43, 44 of the set 20 of tools advantageously allows carrying out all the bending measurements with step p starting from a minimum bending length equal to X. In other words, the set 20 of bending tools allows carrying out bends having lengths comprised between X and X+n-p, where n is an integer more than 1.

The further set 21 of tools comprises a number of basic tools 40 comprised between 1 and 46.

In the embodiment illustrated in the figures, the basic width X is equal to 50 mm and the step p is equal to 10 mm. Therefore, the basic tool 40 has a width equal to 50 mm, while the first tool 41, the second tool 42, the third tool 43 and the fourth tool 44 have lengths equal to 60 mm, 70 mm, 80 mm, 90 mm, respectively. In the illustrated embodiment, the further set 21 of tools comprises thirty-six basic tools 40 for a total number of tools of the set 20 of fifty-one.

With reference to FIG. 3, the bending tools 40, 41, 42, 43, 44, which take the corresponding positions 1 to 51, are mounted on the crosspiece 3 in sequence starting from the left end 3*a* of said crosspiece 3 (when observing the machine from the rear part). The set 20 provides the first tools 41 in the positions 1 to 4, the second tool 42 in the position 5, the third tool 43 in the position 6, the basic tool 40 in the position 7, the third tools 43 in the positions da 8 a 10, the fourth tool 44 in the position 11, the basic tools 40 in the positions 12 and 13, the first tool 41 in the position 14, the second tool 42 in the position 15, and the basic tools 40 in the positions 16 to 51.

By suitably combining different adjacent bending tools 40, 41, 42, 43, 44 of the set 20 mounted on the crosspiece 3, it is possible to carry out all the bending lengths necessary to perform the workings on the piece 50.

By way of example, and with reference to FIG. 4, in order to carry out a bend with a length of 400 mm on the workpiece 50, it is necessary to arrange a first composition C1 of tools in which the tools 10 to 15 of the set 20 are arranged adjacent and in sequence, and more precisely one third tool 43 (80 mm), one fourth tool 44 (90 mm), two basic tools 40 (50 mm×2), one first tool 41 (60 mm) and one second tool 42 (70 mm). The bending tools of the first composition C1 are positioned by the moving assembly 5, 6 along the crosspiece 3 in the operative position where they can interact with the workpiece 50, while the tools 1 to 9 and those from 16 a 51 are moved to the opposite ends of the crosspiece 3 in order not to interact with the piece 50.

It shall be noticed that in order to obtain a bending length of 390 mm, it is instead necessary to select the tools 1 to 6 of the set 20 so as to form a corresponding composition.

Again by way of example and with reference to FIG. 5, in order to carry out a bending length of 1190 mm, it is instead necessary to arrange a second composition C2 of tools in which the tools 2 to 20 of the set 20 are arranged adjacent and in sequence, and more precisely, three first tools 41 (60 mm×3), one second tool 42 (70 mm), one third tool 43 (80 mm), one basic tool 40 (50 mm), three third tools 43 (80 mm×3), one fourth tool 44 (90 mm), two basic tools 40 (50 mm×2), one first tool 41 (60 mm), one second tool 42 (70 mm) and five basic tools 40 (50 mm×5).

The tools of the second composition C2 are positioned by the moving assembly 5, 6 along the crosspiece 3 in the operative position where they can interact with the piece 50, while the tool in the position 1 and those in the positions 21 to 51 are moved to the opposite ends of the crosspiece 3.

Figure 8:
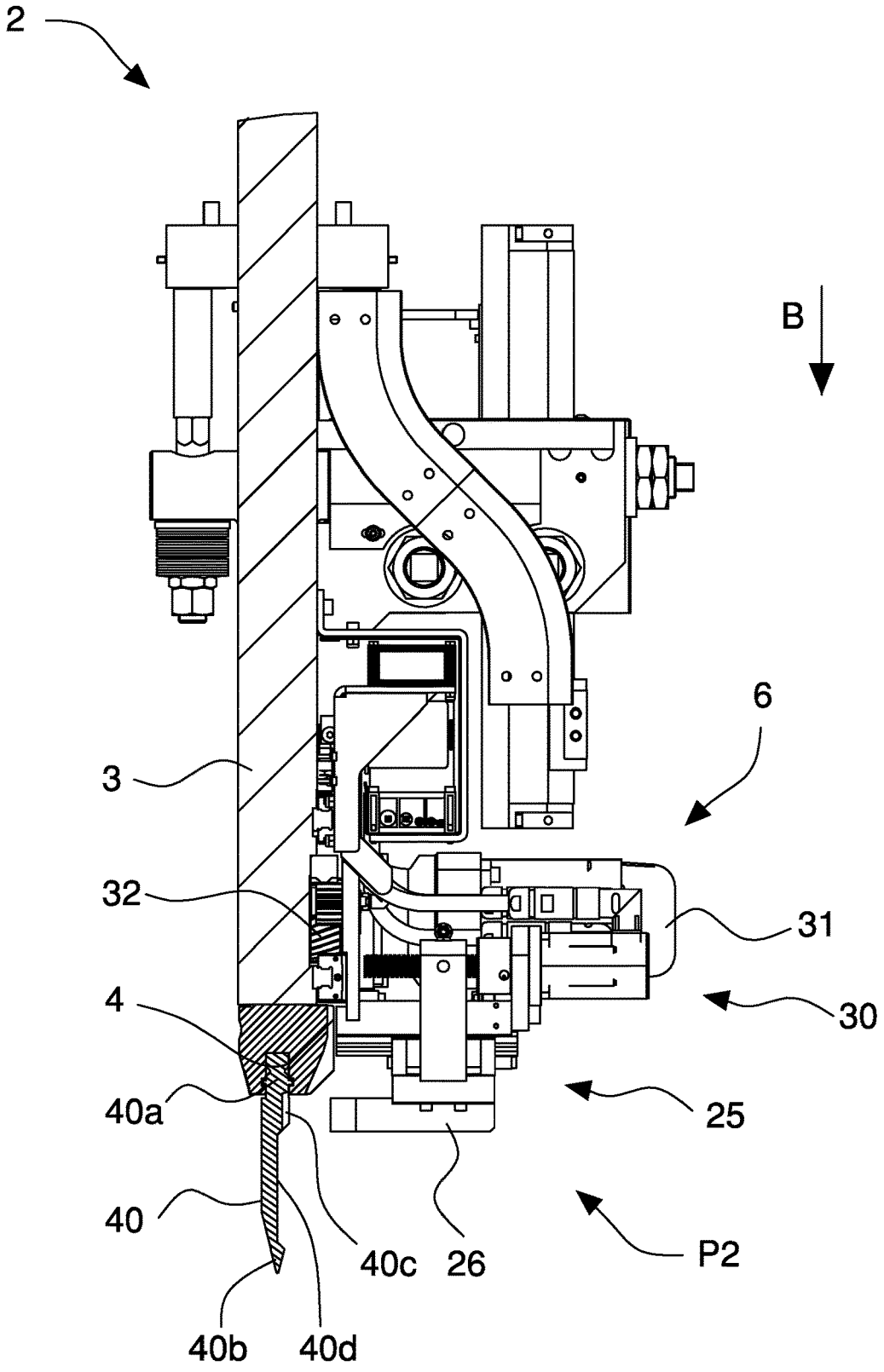
FIG. 8 is a section view according to the line VIII-VIII of FIG. 4.
Figure 9:
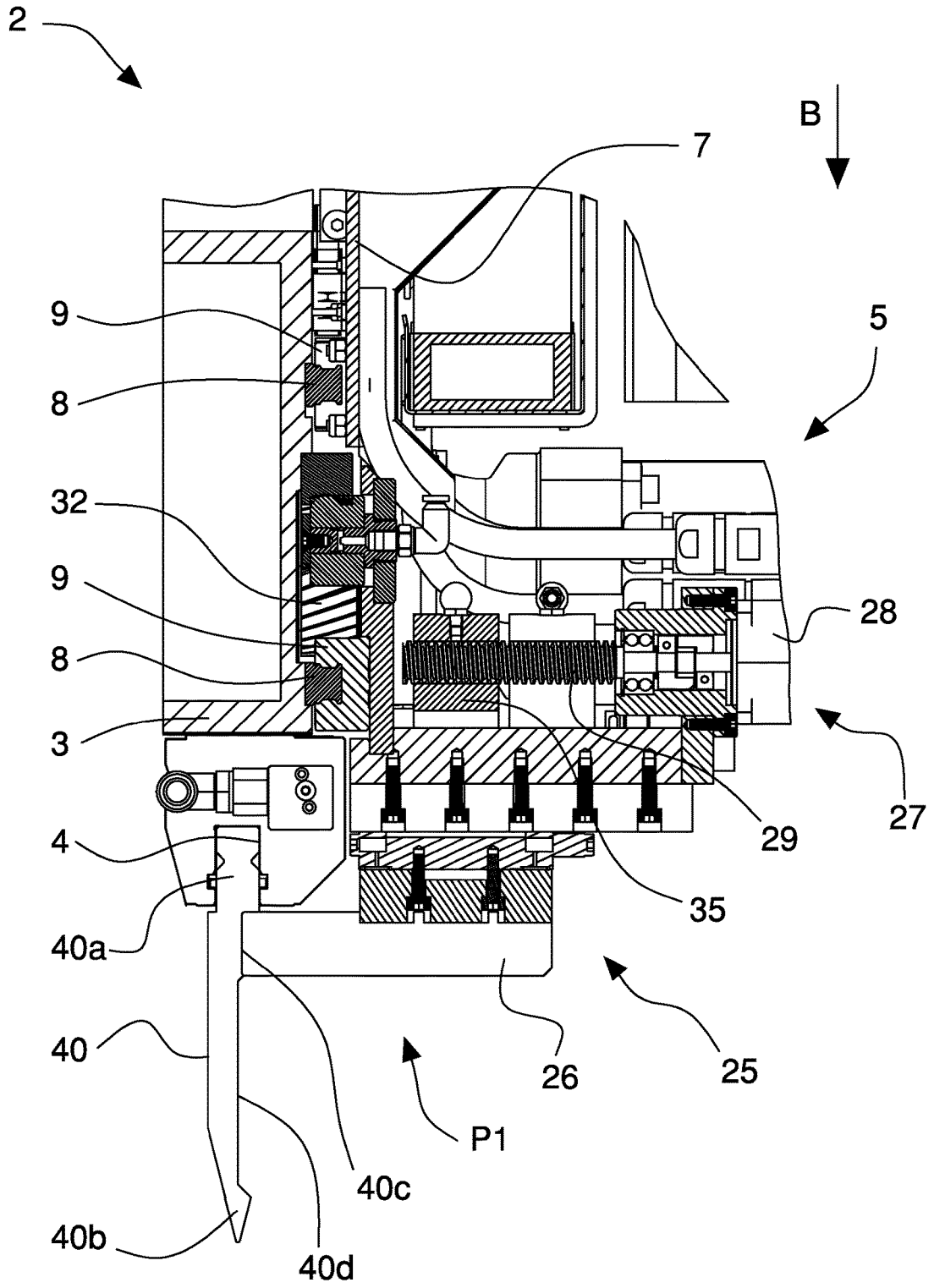
FIG. 9 is a section view according to the line IX-IX of FIG. 7.
Figure 10:
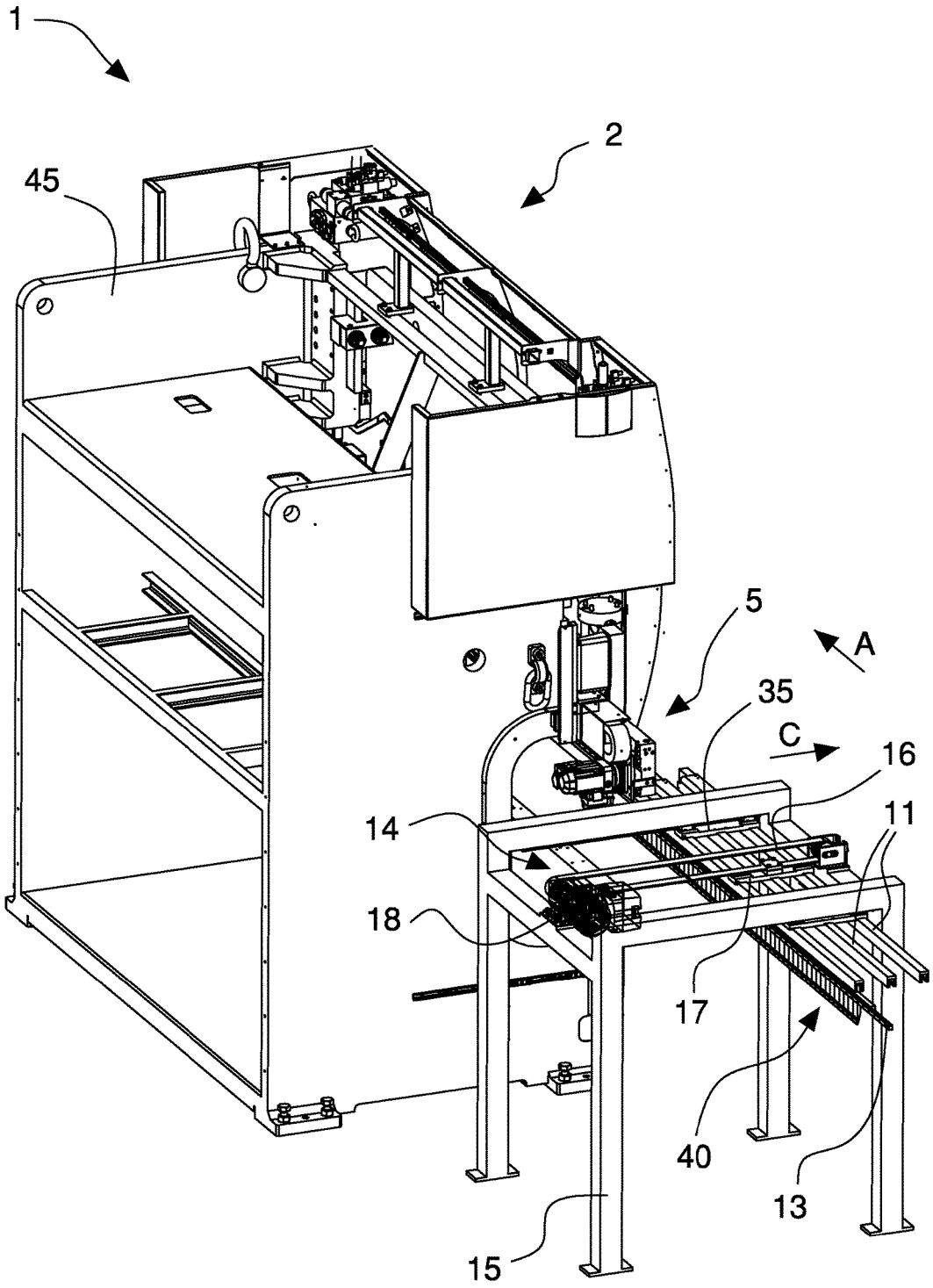
FIG. 10 is a side perspective view of the machine of FIG. 1.
Figure 11:
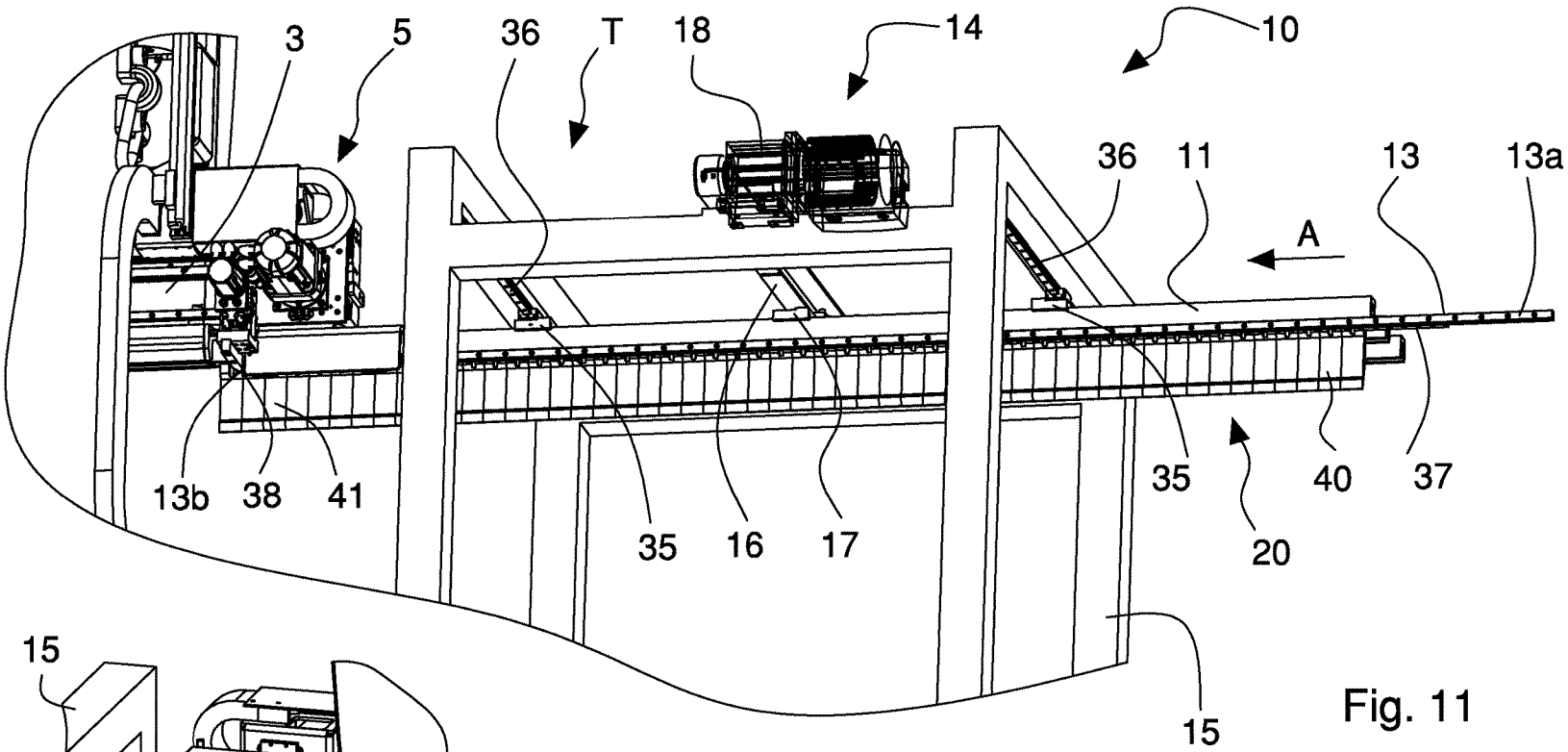
FIG. 11 is a partial and interrupted rear perspective view of the machine of FIG. 1.
Figure 12:
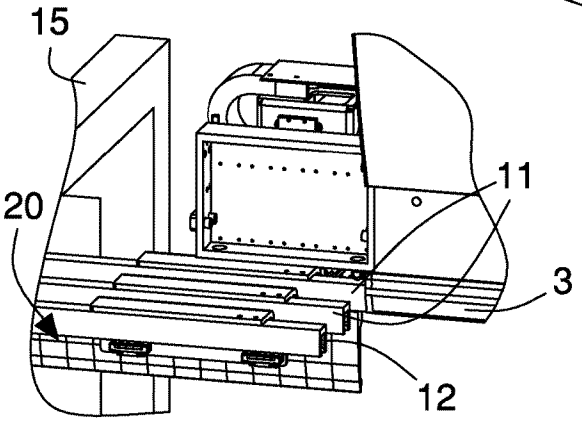
FIG. 12 is an enlarged detail of FIG. 1.

The tool holder crosspiece 3 comprises a longitudinal guide 4 suitable to slidably support the bending tools 40, 41, 42, 43, 44 along the first direction A. The guide 4 comprises in particular a longitudinal guiding groove 4 carried out in the crosspiece 3 within which connecting ends of the bending tools are slidably inserted. The connecting ends are opposed to operating ends interacting with the workpiece. With reference to FIGS. 8 and 9, the longitudinal guiding groove 4 receives with a clearance a connecting end 40*a* of the basic tool 40 provided with a corresponding operating end 40*b* interacting with the workpiece 50 to be processed.

The bending assembly 2 comprises a locking device associated to the crosspiece 3 and in particular to the guide 4 of the latter, which are selectively activable to lock the set 20 of bending tools 40, 41, 42, 43, 44 to the same crosspiece 3 so as to prevent a displacement thereof along the first direction A in an operative configuration where the above-mentioned bending tools act on the piece 50.

The locking device, of a known type and not illustrated in the figures, comprises, for example, a plurality of locking elements inserted in the longitudinal groove 4 and pneumatically driven so as to firmly lock all the bending tools in the respective longitudinal positions in the operative configuration.

The moving assembly 5, 6 of the bending assembly 2 comprises, in the embodiment illustrated in the figures, a first carriage 5 and a second carriage 6, both being mobile along the crosspiece 3 parallel to the first direction A and provided with a respective connecting device 25 capable of coupling a defined bending tool 40, 41, 42, 43, 44 in a gripping condition P1, so as to move said bending tool 40, 41, 42, 43, 44 and a plurality of bending tools adjacent thereto, along the first direction A.

The moving assembly 5, 6 allows arranging the bending tools 40, 41, 42, 43, 44 of the set 20 along the crosspiece 3 according to the length of the bend to be carried out. In other words, the moving assembly 5, 6 allows selecting the number and type of tools 40, 41, 42, 43, 44, and positioning said tools along the first direction A in order to form the necessary composition of tools necessary to carry out the bend with the required length.

Figure 7:
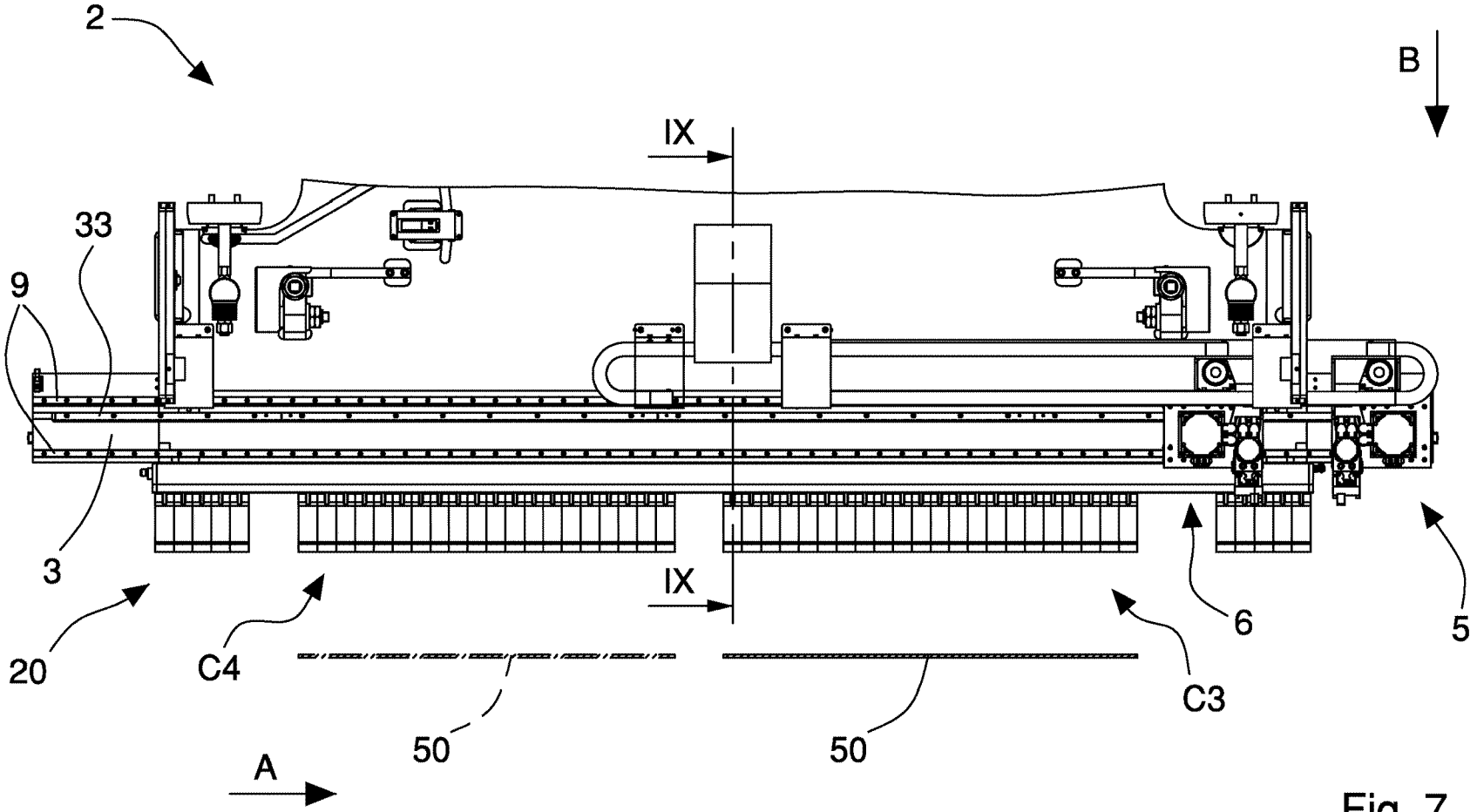
FIG. 7 is a rear view of the bending assembly of FIG. 2 showing two tool compositions suitable to perform two successive bends on the workpiece.

The moving assembly 5, 6 also allows forming and positioning a plurality of compositions of bending tools along the crosspiece 3 in order to carry out in sequence respective successive bending operations on the same workpiece 50, to obtain the final product (FIG. 7).

In the example of FIG. 7, two compositions C3, C4 respectively having twenty and twenty-two bending tools, are provided on the crosspiece 3 for carrying out on the workpiece 50 two distinct and subsequent bending lines.

With particular reference to FIGS. 8 and 9, each carriage 5, 6 comprises a respective supporting plate 7 provided with shoes 8 suitable to slidably engage on linear guides 9 fixed to the crosspiece 3 and parallel to the first direction A.

First driving means 30 is fixed to the supporting plate 7 and comprises a first electric rotary motor 31, which actuates directly or by means of reducing gears a toothed wheel 32 engaging a rack 33 fixed to the crosspiece 3. By rotating the toothed wheel 32 the carriage 5, 6 is linearly moved. Sensor means is provided, which is connected to the managing and controlling unit and arranged to detect precisely the position of the carriages 5, 6 along the crosspiece 3 in order to enable the managing and controlling unit to move and precisely position said carriages 5, 6.

Each carriage 5, 6 comprises a respective connecting device 25 including a locking pin 26 mobile in a direction transversal, in particular orthogonal, to the first direction A so as to engage, in the connection position P1, a slot carried out on a front face of the bending tool, for example, a corresponding slot 40*c* manufactured on a front face 40*d* of the basic tool 40 (FIGS. 8 and 9).

The locking pin 26 is linearly driven between the connection position P1 and a disengaging position P2 by second driving means 27. The latter comprises, for example in the illustrated embodiment, a second electric rotary motor 28, which rotatably drives a screw 29 capable of linearly moving a screw nut 35 connected to the locking pin 26.

Alternatively, the second driving means may comprise a linear electric motor connected to the locking pin 26, or a pneumatic linear actuator.

The operation of the bending machine 1 of the invention provides a configuring step of the bending tools of the set 20 necessary to arrange on the crosspiece 3 the composition of tools needed to perform on the workpiece 50 the bend with the desired length.

To this purpose, the locking device, which restrains the tools to the longitudinal guiding groove 4 carried in the crosspiece 3, is deactivated so as to allow the free sliding of the tools along said crosspiece 3. The first carriage 5 and/or the second carriage 6 are thus moved at selected tools, which are coupled by the connecting devices 25 (which are driven so that the locking pin 26 engages the slot of the bending tool in the connection position P1). In this manner, one or more adjacent tools are selected and suitably positioned along the crosspiece 3 in order to carry out the required composition of tools.

The unused tools are moved by the moving assembly 5, 6 to the opposite ends of the crosspiece 3.

Two or more tool compositions C3, C4 can be prearranged on the crosspiece 3 to carry out sequentially respective successive bending operations on the same workpiece in order to obtain the final product (FIG. 7).

Therefore, thanks to the bending machine 1 of the invention it is possible to carry out with a same set 20 of bending tools mounted on the tool holder crosspiece 3 bends which have lengths that are variable in a continuous manner with a step equal to p (10 mm), starting from a minimum value equal to the basic width X (50 mm) up to a value $X+n \cdot p$, where n is an integer more than 1, without needing to replace the tools. In fact, by suitably separating and grouping the tools, it is possible to obtain all the required tool compositions to carry out all the different bending lengths by simply separating the selected tools (always mutually adjacent) from the remaining tools, without the need of assembling to or disassembling from the crosspiece 3 the tools picked up from a tool holder magazine.

To be noted that the selection of tools 40, 41, 42, 43, 44 inserted in the guide 4 of the crosspiece 3 and the mutual positions thereof (1 to 51) do not change during the operation: in other words, no assembling/disassembling operation of the tools to/from the crosspiece is required. The dimensions of the basic tools 40 and of the size tools 41, 42, 43, 44, the number and mutual arrangement thereof are such as to allow obtaining all the required compositions with steps of 10 mm.

Thus, it is possible to arrange in a fast and precise manner the bending tools 40, 41, 42, 43, 44 needed for the required workings, thus minimizing the machine downtimes, i.e. speeding up the workpiece machining time.

It shall be noticed that the bending machine 1 of the invention allows obtaining in a fast and easy manner all the desired tool compositions even during the operative cycle of a workpiece, without unduly increasing its duration, this allowing carrying out on the piece 50 a plurality of different bends which should be usually carried out, in an operative cycle with an acceptable duration, only by using two or more bending machines arranged in line.

The set 20 of tools and the moving assembly 5, 6 allows also positioning and defining different tool compositions along the crosspiece 3 (FIG. 7) even during a same operative cycle of a workpiece in order to carry out on the workpiece 50 in the same bending machine a plurality of different and subsequent workings.

Hence, the bending machine 1 of the invention provides a high operative flexibility and an optimization of the operative cycles of the workpiece.

The bending machine 1 also comprises a tool holder magazine 10 capable of supporting and receiving the set 20 of bending tools 40, 41, 42, 43, 44, and more precisely, as best set forth in the following of the description, a plurality of different sets 20 of bending tools to be mounted on the bending assembly 2 to carry out specific workings on the workpieces, in particular bends having different shapes and bending geometries.

The tool holder magazine 10 is positioned adjacent and at the side of the bending assembly 2 and comprises at least one supporting guide 11 which is mobile and which can be positioned in a transfer position T, where it is aligned to the tool holder crosspiece 3 along the first direction A so as to receive from, or release to, the crosspiece 3 the set 20 of bending tools, thus allowing carrying out an exchange of the tools for a new, different operation cycle. In order to allow replacing the set 20 of tools, the crosspiece 3 is arranged to a non-operative position, where it is lifted and more spaced apart from the workpiece 50 to be processed.

The moving assembly 5, 6 of the bending assembly 2 moves the bending tools 40, 41, 42, 43, 44 along the guiding groove 4 of the crosspiece 3 and/or along the support means 11 to extract the set 20 of tools from the crosspiece 3 and to insert the set into the supporting guide 11 or to pick up a set 20 of bending tools from the supporting guide 11, as best explained in the following of the description.

The tool holder magazine 10 comprises a pulling device 13 slidably connected to each supporting guide 11 and arranged to engage the bending tools when the latter ones are housed in the respective supporting guides 11 and to move said bending tools when exiting the tool holder magazine 10 towards the crosspiece 3. The pulling device 13 is driven by the moving assembly 5, 6 of the bending assembly 2. More precisely, the connecting device 25 of the moving means 5, 6, in addition to engaging the bending tools to transfer the set 20 of bending tools from the crosspiece 3 to the supporting guide 11, is capable of coupling the pulling device 13 so as to move, by means of the latter, the set 20 of tools from the supporting guide 11 to the crosspiece 3.

In the shown embodiment, the pulling device comprises a rod 13 slidably fixed to the corresponding supporting guide 11 parallel to the first direction A and having a length equal to or greater than the length of the supporting guide 11. The rod 13 comprises a first end 13*a* which is opposed to, and farther from, the crosspiece 3 and which is provided with an abutment element 37 suitable to abut against the bending tool 40 that is the outermost and farthest one from the crosspiece 3. The rod 13 has also a second end 13*b*, which is nearer and more adjacent to the crosspiece 3 and is provided with a connecting element 38 intended to be engaged by the connecting device 25 of the moving assembly 5, 6. More precisely, the connecting element 38 can be engaged by the locking pin 26 of the connecting device 25 of the first carriage 5 in the connection position P1. In this manner, the moving assembly of the bending assembly 2, in particular the first carriage 5, moved along the crosspiece 3 in the first direction A, can pull and move the rod 13, hence the set 20 of bending tools exiting the tool holder magazine 10, from the supporting guide 11 to the crosspiece 3.

With reference to FIGS. 1, 10, 11 and 12, the tool holder magazine 10 comprises a supporting frame 15 that slidably supports plurality of supporting guides 11 suitable to receive respective interchangeable sets 20 of bending tools 40, 41, 42, 43, 44 to be mounted on the bending assembly 2. The supporting guides 11 are arranged, for example, mutually spaced apart and parallel to the first direction A.

Each supporting guide 11 of the tool holder magazine 10 is provided with a longitudinal seat 12 suitable to slidably receive and support a respective set of bending tools 20. The longitudinal seat 12 in the transfer position T is aligned and adjacent to the guide 4 of the crosspiece 3 to allow the transfer of the set 20 of bending tools.

A positioning system 14 is provided to move the supporting guides 11 so as to position a predetermined supporting guide 11 aligned and adjacent to the guide 4 of the crosspiece 3 so as to receive from, or release to, the latter a respective set of bending tools.

In the shown embodiment, the positioning system 14 moves the supporting guides 11 along a third direction C transversal, in particular orthogonal, to the first direction A and horizontal, so as to align a predetermined supporting guide 11 to the crosspiece 3.

The positioning system 14 comprises, for example, a closed-loop belt 16, fixed by a connecting plate 17 to the supporting guides 11 and driven by a third electric rotary motor 18.

Supporting means 35, 36 is provided to slidably fix the supporting guides 11 to the supporting frame 15. The supporting means 35, 36 comprises, for example, a couple of further connecting plates 35 fixed to the supporting guides 11 and slidably coupled to respective tracks 36 fixed to the supporting frame 15, parallel to one another and to the third direction C.

In a variant of the bending machine not shown, the positioning system can comprise a "revolver" type system, in which the supporting guides 11 are mounted so as to rotate about an axis which is horizontal and parallel to the first direction A.

The operation of the bending machine 1 of the invention provides a replacement step of the bending tools, in which the set 20 of bending tools mounted on the tool holder crosspiece 3 can be easily and quickly disassembled and replaced by another different set 20 of bending tools present in the tool holder magazine 10 of the machine 1. With the crosspiece 3 in the non-operative lifted position, the locking devices (which constrain the tools 40, 41, 42, 43, 44 to the longitudinal guiding groove 4 of the crosspiece 3) are deactivated so as to allow the free sliding of the tools 40, 41, 42, 43, 44 along the first direction A. Thus, the first carriage 5 is moved at the outermost tool on the opposite part with respect to the tool holder magazine 10 (first tool 41 at position 1 as in FIG. 3) and the corresponding connecting device 25 is actuated so that the locking pin 26 engages in the connection position P1 a slot carried on a front face of said outermost tool.

The second carriage 5 moved along the first direction A towards the tool holder magazine 10, by acting on the outermost tool, can thus push the whole set 20 of tools along the crosspiece 3 towards a respective supporting guide 11 of the tool holder magazine 10 which is empty and intended to receive said tools. To this purpose, the supporting guide 11 is arranged by the positioning system 14 in the transfer position T, where the longitudinal seat 12 of said supporting guide 11 is aligned and adjacent to the longitudinal guiding groove 4 of the crosspiece 3.

Once the set 20 of tools has been inserted in the corresponding supporting guide 11, the locking pin 26 of the connecting device 25 of the first carriage 5 is disengaged from the outermost tool (first tool 41), and the first carriage 5 is moved along the crosspiece 3 towards the inside of the machine 1 to allow the positioning system 14 moving along the third direction C the supporting guide 11, which has just received from the bending assembly 2 the set 20 of tools and to arrange in the transfer position T another supporting guide 11 containing the set of bending tools which is desired to be assembled on the bending assembly 2 in order to carry out a corresponding processing cycle.

To load the new set of bending tools on the crosspiece 3, the first carriage 5 is moved so that the corresponding connecting device 25 may engage the pulling device 13 of the supporting guide 11. In particular, the first carriage 5 is moved in a position in which the locking pin 26 can engage the connecting element 38 of the second end 13*b* of the rod 13 of the pulling device. At this point, by moving the first carriage 5 in the first direction A towards the inside of the machine 1, the rod 13 by the abutment element 37 fixed to the first end 13*a* and abutting the bending tool of the set 20 that is the outermost and farthest one from the crosspiece 3 (basic tool 40 in the position 51 with reference to FIG. 3), can push the set of tools out of the supporting guide 11 into the longitudinal guiding groove 4 of the tool holder crosspiece 3.

Once the new set of bending tools has been transferred on the crosspiece 3, the first carriage 5 is moved to the opposite direction along the first direction A to bring the rod 13 back into of the tool holder magazine 10 in a beginning-of-stroke position.

Therefore, thanks to the bending machine 1 of the invention, it is possible to replace in an easy, fast, and efficient manner the bending tools mounted on the tool holder crosspiece 3, in particular, to replace a set 20 of bending tools with another set of tools in order to carry out a different processing cycle.

The moving assembly 5, 6, in addition to allow positioning in a rapid and precise manner the bending tools 40, 41, 42, 43, 44 on the crosspiece 3 along the first direction A according to the required working(s), allows replacing the set 20 of tools, i.e. inserting in or picking up from the magazine a set 20 of tools, in cooperation with the pulling device 13, in a fast and easy manner, thus minimizing the bending machine downtimes.

Hence, tools are replaced by using the same moving assembly 5, 6 which allows positioning the bending tools along the crosspiece 3, without requiring specific driving means intended to pick up from the tool holder magazine, or to insert into the latter, the set of tools, this allowing simplifying the machine structure and reducing the cost thereof.

Finally, it shall be noticed that the moving and replacement system of the tools, comprising the moving assembly 5, 6 and the supporting guides 11 provided with the pulling device 13 of the tool holder magazine 10, has a simply, inexpensive structure and an efficient and reliable operation.

In a variant of the bending machine that is not shown in the figures, the pulling device comprises powered carriages, each of which is slidably connected to the corresponding supporting guide 11 and mobile along the latter to engage and push the set 20 of bending tools from said supporting guide 11 to the crosspiece 3. The powered carriage acts onto the bending tool of said set 20 of bending tools which is the outermost and farthest one from the crosspiece 3 and pushes the whole set 20 of bending tools along the supporting guide 11 on the crosspiece 3.

In this variant of the bending machine 1, the moving assembly 5, 6 is used only to transfer the set 20 of bending tools from the crosspiece 3 to the respective supporting guide 11, inside the tool holder magazine.

The powered carriages are inexpensive, reliable components which allow moving in a precise manner the bending tools along the supporting guides 11.

Another variant of the bending machine 1 of the invention, not shown in the figures, provides a further tool holder crosspiece opposed to the first tool holder crosspiece 3, arranged, for example, under the latter and under a worktable and mobile from the bottom to the top to interact with and bend the workpiece 50.

The further crosspiece supports a respective set of bending tools mounted adjacent aligned and mutually positionable along the first direction A so as to form predetermined compositions of tools. The bending tools of the further crosspiece may cooperate with the bending tools of the crosspiece 3 to carry out bends on the workpiece 50, or they can operate independently and distinctly in order to obtain respective bends on the workpiece 50.

In this variant of the bending machine, the tool holder magazine 10 comprises one or more further supporting guides, each of which is mobile and which can be positioned in a respective further transfer position in which the said further supporting guide is aligned to the further tool holder crosspiece along the first direction A to receive from, or to release to, the further tool holder crosspiece the set of bending tools. In order to allow replacing the set of tools, the further tool holder crosspiece is arranged in a respective non-operative position in which it is lowered and more spaced part from the workpiece 50.

The further supporting guides are moved by the moving assembly 5, 6 and they are arranged, for example, mutually spaced apart and parallel to one another and to the supporting guides 11. Each further supporting guide is provided with a corresponding further longitudinal seat suitable to slidably receive and support a corresponding set of bending tools.

The invention claimed is:

1. A bending machine for sheet metal, the bending machine comprising a bending assembly provided with a tool holder crosspiece which is mobile and supports a set of bending tools that are aligned, and mutually positionable, along a longitudinal first direction so as to form predetermined compositions of bending tools to bend a workpiece according to respective defined bending lines, said bending assembly comprising a moving assembly for moving said bending tools along said tool holder crosspiece, wherein said set of bending tools comprises, arranged adjacent and in sequence starting from an end of said tool holder crosspiece:

four first bending tools having a width equal to X+p;

one second bending tool having a width equal to X+2·p;

one third bending tool having a width equal to X+3·p;

one basic bending tool having a width equal to X;

three third bending tools;

one fourth bending tool having a width equal to X+4·p;

two basic bending tools;

one first bending tool;

one second bending tool; and a further set of basic bending tools, and wherein:

X is a basic width of said basic bending tool that is between 30 and 70 mm;

p is a step between two lengths of successive tool compositions that is between 5 and 20 mm; and a combination of one or more adjacent bending tools of said set of bending tools allows for execution of bends having all lengths starting from a minimum bending length equal to said basic width with said step.

2. The bending machine according to claim 1, wherein said basic width is equal to 50 mm and wherein said step is equal to 10 mm.

3. The bending machine according to claim 1, wherein said further set of basic bending tools comprises a number of basic bending tools between 1 and 46.

4. The bending machine according to claim 1, wherein said tool holder crosspiece comprises a longitudinal guide for slidably receiving and supporting said bending tools along said longitudinal first direction.

5. The bending machine according to claim 1, wherein said moving assembly comprises a first carriage that is mobile along said tool holder crosspiece parallel to said longitudinal first direction and provided with a connecting device arranged for coupling a defined bending tool in a connection position so as to move at least said defined bending tool along said longitudinal first direction.

6. The bending machine according to claim 5, wherein said moving assembly further comprises a second carriage that is movable along said tool holder crosspiece parallel to said longitudinal first direction and provided with a respective connecting device for coupling a defined bending tool in a connection position so as to move at least said defined bending tool along said longitudinal first direction.

7. The bending machine according to claim 1, further comprising a locking device associated to said tool holder crosspiece and selectively activable to lock said bending tools to said tool holder crosspiece so as to prevent a shift thereof along said longitudinal first direction.

8. The bending machine according to claim 1, further comprising a die arranged for cooperating with said bending tools to carry out bends on said workpiece.

9. The bending machine according to claim 1, further comprising a tool holder magazine suitable for supporting and receiving at least said set of bending tools and provided with at least a supporting guide that is movable and positionable in a transfer position in which said supporting guide is aligned along said longitudinal first direction with said tool holder crosspiece, which is positioned in a non-operative position so as to receive from, or release to, said tool holder crosspiece said set of bending tools.

10. The bending machine according to claim 9, wherein said supporting guide comprises a longitudinal seat suitable to slidably receive and support said set of bending tools, said longitudinal seat being aligned and adjacent, in said transfer position, to a guide of said tool holder crosspiece to enable said bending tools to be transferred.

11. A bending machine for sheet metal, the bending machine comprising:

a bending assembly comprising a tool holder crosspiece which is movable and supports a set of bending tools which are aligned, and mutually positionable, along a longitudinal first direction so as to form defined compositions of bending tools and a moving assembly for moving said bending tools along said tool holder crosspiece; and a tool holder magazine arranged adjacent to, and at the side of, said bending assembly to support and receive at least said set of bending tools and comprising at least a supporting guide which is movable and positionable in a transfer position in which said supporting guide is aligned to said tool holder crosspiece to receive from, or release to said tool holder crosspiece, said set of bending tools, wherein said tool holder magazine comprises a pulling device associated to said supporting guide and arranged to engage said bending tools when said bending tools are aligned in said supporting guide, said moving assembly comprising a connecting device suitable to engage said bending tools in order to move said bending tools along said tool holder crosspiece and to transfer said set of bending tools from said tool holder crosspiece to said supporting guide and suitable to couple said pulling device so as to move, by means of said pulling device, said set of tools from said supporting guide to said tool holder crosspiece.

12. The bending machine according to claim 11, wherein said pulling device comprises a rod slidably connected to said supporting guide parallel to said longitudinal first direction and comprising a first end, which is opposite and farther from said tool holder crosspiece and which is provided with an abutment element suitable to abut against a bending tool of said set of bending tools that is outermost and farthest from said tool holder crosspiece, and a second end which is nearer and more adjacent to said tool holder crosspiece and which is provided with a connecting element suitable to be engaged by said connecting device of said moving assembly.

13. The bending machine according to claim 11, wherein said moving assembly comprises a first carriage that is movable along said tool holder crosspiece parallel to said longitudinal first direction and provided with said connecting device arranged for coupling a defined bending tool in a connection position so as to move at least said defined bending tool along said longitudinal first direction.

14. The bending machine according to claim 13, wherein said moving assembly further comprises a second carriage that is movable along said tool holder crosspiece parallel to said longitudinal first direction and provided with a respective connecting device for coupling a defined bending tool in a connection position so as to move at least said defined bending tool along said longitudinal first direction.

15. The bending machine according to claim 11, further comprising locking elements associated to said tool holder crosspiece and activable to block said bending tools to said tool holder crosspiece so as to prevent a shift thereof along said longitudinal first direction.

16. The bending machine according to claim 11, wherein said tool holder crosspiece comprises a longitudinal guide suitable to slidably receive and support said bending tools along said longitudinal first direction.

17. The bending machine according to claim 11, wherein said supporting guide comprises a longitudinal seat for slidably receiving and supporting said set of bending tools, said longitudinal seat being aligned and adjacent, in said transfer position, to a guide of said tool holder crosspiece to enable said bending tools to be transferred.

18. The bending machine according to claim 11, wherein said tool holder magazine comprises a plurality of supporting guides suitable to receive respective interchangeable sets of bending tools to be mounted on said bending assembly.

19. The bending machine according to claim 18, wherein said supporting guides are arranged mutually spaced apart in parallel to said longitudinal first direction.

20. The bending machine according to claim 18, comprising a positioning system to move said supporting guides and to align one predetermined supporting guide to said tool holder crosspiece in said transfer position so as to receive from, or release to, said tool holder crosspiece a respective set of bending tools.

21. A bending machine for sheet metal, the bending machine comprising:

a bending assembly comprising a tool holder crosspiece which is movable and supports a set of bending tools which are aligned, and mutually positionable, along a longitudinal first direction so as to form predetermined compositions of bending tools and a moving assembly for moving said bending tools along said tool holder crosspiece; and a tool holder magazine arranged adjacent to, and at the side of, said bending assembly to support and receive at least said set of bending tools and comprising at least a supporting guide which is movable and positionable in a transfer position, wherein said supporting guide is aligned to said tool holder crosspiece to receive from, or release to, said tool holder crosspiece said set of bending tools, and wherein said moving assembly is arranged to move and transfer said set of bending tools from said tool holder crosspiece to said supporting guide and in that said tool holder magazine comprises a pulling device slideably connected to said supporting guide and arranged to engage and transfer said set of tools from said supporting guide to said tool holder crosspiece.

22. The bending machine according to claim 21, wherein said pulling device comprises a powered carriage that is slidably connected to said supporting guide and movable along said supporting guide to engage and push said set of bending tools from said supporting guide to said tool holder crosspiece.

23. The bending machine according to claim 22, wherein said powered carriage acts on a bending tool of said set of bending tools that is outermost and farthest from said tool holder crosspiece.

24. The bending machine according to claim 21, wherein said moving assembly comprises at least a first carriage that is movable along said tool holder crosspiece parallel to said longitudinal first direction and provided with a connecting device arranged to couple a defined bending tool in a connection position so as to move at least said defined bending tool along said longitudinal first direction.

25. The bending machine according to claim 21, wherein said supporting guide comprises a longitudinal seat arranged to slidably receive and support said set of bending tools, said longitudinal seat being aligned and adjacent, in said transfer position, to a longitudinal guide of said tool holder crosspiece to enable said bending tools to be transferred, said longitudinal guide being arranged for slidably receiving and supporting said bending tools along said longitudinal first direction.

26. The bending machine according to claim 21, wherein said tool holder magazine comprises a plurality of supporting guides that are suitable to receive respective interchangeable sets of bending tools to be mounted on said bending assembly.

27. The bending machine according to claim 26, wherein said supporting guides are arranged mutually spaced apart in parallel to said longitudinal first direction.

28. The bending machine according to claim 26, further comprising a positioning system for moving said supporting guides and aligning a predetermined supporting guide to said tool holder crosspiece in said transfer position so as to receive from, or release to, said tool holder crosspiece a respective set of bending tools.

* * * * *